US009174459B2

(12) United States Patent
Imai

(10) Patent No.: US 9,174,459 B2
(45) Date of Patent: Nov. 3, 2015

(54) IMAGING SYSTEM, WRITING HEAD, AND IMAGE FORMING APPARATUS

(71) Applicant: Shigeaki Imai, Kanagawa (JP)

(72) Inventor: Shigeaki Imai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/199,038

(22) Filed: Mar. 6, 2014

(65) Prior Publication Data

US 2014/0267528 A1 Sep. 18, 2014

(30) Foreign Application Priority Data

Mar. 13, 2013 (JP) ..... 2013-050431

(51) Int. Cl.
*B41J 2/47* (2006.01)
*B41J 2/45* (2006.01)

(52) U.S. Cl.
CPC ..... *B41J 2/451* (2013.01)

(58) Field of Classification Search
CPC ..... B41J 2/47; B41J 2/451; B41J 2/471; H04N 1/1135
See application file for complete search history.

(56) References Cited

U.S. PATENT DOCUMENTS

| | | | | |
|---|---|---|---|---|
| 2003/0007067 | A1 | 1/2003 | Masuda et al. | |
| 2004/0165240 | A1 | 8/2004 | Suzuki et al. | |
| 2004/0240000 | A1 | 12/2004 | Miyatake et al. | |
| 2004/0257429 | A1* | 12/2004 | Iizuka et al. | 347/241 |
| 2005/0094234 | A1 | 5/2005 | Miyatake et al. | |
| 2005/0190420 | A1 | 9/2005 | Imai et al. | |
| 2006/0158711 | A1 | 7/2006 | Imai et al. | |
| 2007/0058255 | A1 | 3/2007 | Imai et al. | |
| 2007/0146849 | A1 | 6/2007 | Miyatake et al. | |
| 2007/0236557 | A1 | 10/2007 | Imai et al. | |
| 2008/0019255 | A1 | 1/2008 | Imai et al. | |
| 2008/0068678 | A1 | 3/2008 | Suzuki et al. | |
| 2008/0170283 | A1 | 7/2008 | Imai | |
| 2008/0192323 | A1 | 8/2008 | Nakamura et al. | |
| 2008/0259426 | A1 | 10/2008 | Imai | |
| 2009/0058979 | A1 | 3/2009 | Saisho et al. | |
| 2009/0073529 | A1 | 3/2009 | Imai | |
| 2009/0073531 | A1 | 3/2009 | Imai | |
| 2009/0074437 | A1 | 3/2009 | Tanabe et al. | |
| 2009/0225385 | A1 | 9/2009 | Imai | |
| 2009/0231654 | A1 | 9/2009 | Imai | |

(Continued)

FOREIGN PATENT DOCUMENTS

| | | |
|---|---|---|
| JP | 63-225218 | 9/1988 |
| JP | 4-336559 | 11/1992 |

(Continued)

*Primary Examiner* — Manish S Shah
*Assistant Examiner* — Jeremy Delozier
(74) *Attorney, Agent, or Firm* — Oblon, McClelland, Maier & Neustadt, L.L.P.

(57) ABSTRACT

An imaging system includes incidence faces composed of optical faces having an image focusing function; prisms; and exit faces. The incidence faces are arranged with a first pitch along a first axial direction. The prisms are arranged with a second pitch along the first axial direction. The exit faces are arranged with a third pitch along the first axial direction. The first axial direction is set as a Y direction. A normal line direction of a face top of an optical face of the incidence face in a plane perpendicular to the first axial direction is set as a X direction. A direction perpendicular to the Y direction and the X direction is set as a Z direction. In a XZ cross-section plane, a width of the prism in the Z direction is smaller than a width of optical face of the incidence face in the Z direction.

13 Claims, 12 Drawing Sheets

(56) References Cited

U.S. PATENT DOCUMENTS

| | | | | |
|---|---|---|---|---|
| 2010/0045766 | A1 | 2/2010 | Imai et al. | |
| 2010/0310284 | A1 | 12/2010 | Funato et al. | |
| 2011/0102536 | A1 | 5/2011 | Imai | |
| 2012/0056968 | A1 | 3/2012 | Imai et al. | |
| 2012/0182367 | A1 | 7/2012 | Masuda et al. | |
| 2013/0100514 | A1* | 4/2013 | Shiraishi | 359/201.1 |
| 2013/0176602 | A1 | 7/2013 | Miyake et al. | |
| 2013/0235144 | A1 | 9/2013 | Miyake et al. | |
| 2013/0321875 | A1 | 12/2013 | Imai | |
| 2014/0022327 | A1 | 1/2014 | Imai | |

FOREIGN PATENT DOCUMENTS

| | | |
|---|---|---|
| JP | 10-153751 | 6/1998 |
| JP | 2000-108403 | 4/2000 |
| JP | 2000-108405 | 4/2000 |
| JP | 2002-350604 | 12/2002 |

* cited by examiner

IMAGING SYSTEM, WRITING HEAD, AND IMAGE FORMING APPARATUS

CROSS-REFERENCE TO RELATED APPLICATION

This application claims priority pursuant to 35 U.S.C. §119 to Japanese Patent Application No. 2013-050431, filed on Mar. 13, 2013 in the Japan Patent Office, the disclosures of which is incorporated by reference herein in their entirety.

BACKGROUND

1. Technical Field

The present invention relates to an imaging system, a writing head and an image forming apparatus.

2. Background Art

Exposing devices used for image forming apparatuses such as laser printers and copiers include a writing head configured with a light source such as light emitting diode (LED) array and an organic electroluminescence (OEL) array, and a lens array. The lens array of the writing head may employ a gradient index lens array, but light use efficiency of the gradient index lens array may not be sufficient. Therefore, the gradient index lens array may not be employed for high speed apparatuses. Especially, if the OEL is used as the light source, because light quantity of the OEL is smaller than light quantity of the LED, an optical system to enhance light use efficiency is required.

To enhance the light use efficiency of the writing head, an imaging system configured with a lens and a roof prism or with a lens and a roof mirror can be used. In such imaging system, a plurality of optical systems are arranged in a main scanning direction, and the lens array pitch is same as the roof prism array pitch or the roof mirror array pitch. Therefore, this imaging system has a retroreflective optical system that reflects an image for two times in a main scanning direction using the roof prism and the roof mirror, and an "upright image" can be generated in the main scanning direction, and an "inverted image" can be generated in a sub-scanning direction.

In the above described imaging system, if some of the light is focused at a position on an imaging face that should not be focused, ghost light may occur. The ghost light can be suppressed by disposing a slit at the lens array side.

The ghost light can be reduced using the slit having an light absorbing effect, but the light use efficiency becomes lower due to the light absorbing by the slit.

Further, an aperture can be disposed at the incidence face side of the imaging system to suppress light propagation to undesired positions. However, it is very difficult to manufacture an aperture array matched to each incidence face of the imaging system with high precision. Therefore, the aperture may not be practical for preventing occurrence of ghost light.

Further, an aperture can be disposed at the exit face side of the imaging system to suppress occurrence of ghost light. The aperture disposed at the exit face side of the imaging system can be a single aperture, but the single aperture becomes a long aperture in a long side direction of the imaging system. Such long aperture is difficult to manufacture, and strength of the aperture becomes weak, and resultantly the aperture becomes weak to vibration. Therefore, mechanical strength of the imaging system becomes lower.

Further, the number of parts increases when the aperture is disposed as above described. Further, a correct positioning between the aperture and the optical face of the imaging system is required, which increases cost of the imaging system.

SUMMARY

In one aspect of the present invention, an imaging system is devised. The imaging system includes a plurality of incidence faces composed of a plurality of optical faces having an image focusing function; a plurality of prisms; and a plurality of exit faces. The plurality of incidence faces is arranged with a first pitch along a first axial direction. The plurality of prisms is arranged with a second pitch along the first axial direction. The plurality of the exit faces is arranged with a third pitch along the first axial direction. The first axial direction is set as a Y direction. A normal line direction of a face top of an optical face of the incidence face in a plane perpendicular to the first axial direction is set as a X direction. A direction perpendicular to the Y direction and the X direction is set as a Z direction. In a XZ cross-section plane, a width of the prism in the Z direction is smaller than a width of optical face of the incidence face in the Z direction.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
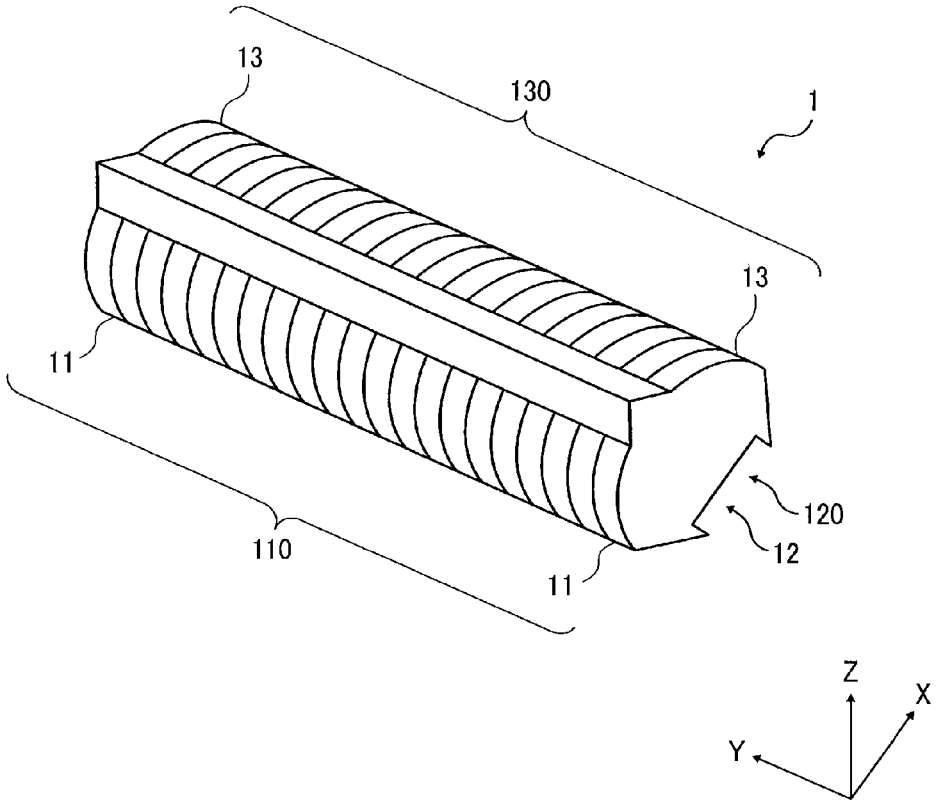
FIG. 1 is a schematic perspective view of an imaging system according to an example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that have the same function, operate in a similar manner, and achieve a similar result.

Referring now to the drawings, a description is given of an apparatus or system for an image projection apparatus such as a projector according to an example embodiment.

A description is given of an imaging system, a writing head, and an image forming apparatus according to an example embodiment with reference to the drawings.

First Example Embodiment of Imaging System

FIG. 1 is a schematic perspective view of a roof prism lens array (RPLA) 1 of an imaging system according to a first example embodiment. The RPLA 1 includes, for example, an incidence face array 110, a prism array 120 and an exit face array 130. The incidence face array 110 includes a plurality of incidence faces 11 having image focusing function. The prism array 120 includes a plurality of prisms 12 disposed on a light path from the incidence face 11.

The exit face array 130 includes a plurality of exit faces 13 having image focusing function disposed on a light path from the prism 12.

As shown in FIG. 1, in the RPLA 1, each of the incidence face 11, the prism 12 and the exit face 13 are arranged in one dimensional direction while facing with each other. The one dimensional direction, which is an arrangement direction of each of the incidence face 11, the prism 12 and the exit face 13 or a long side direction, is referred to as Y direction. Further, an axis along the Y direction is referred to as Y axis or a first axis.

Further, as shown in FIG. 1, a normal direction extending from a face top of an optical face (i.e., incidence face 11) of the incidence face array 110 toward the prism 12 is referred to as X direction, and an axis along the X direction is referred to as X axis. Further, a direction perpendicular to the Y direction and the X direction is set as Z direction, and an axis along the Z direction is referred to as Z axis.

The light beam "a" that has entered the RPLA 1 from the incidence face 11 proceeds along the X direction. Then, the light beam "a" is reflected at the prism 12, and then proceeds along the Z direction. Then, the light beam "a" exits from the exit face 13.

Specifically, the light beam "a" emitted from each one of point light sources, disposed at the incidence face 11 side, enters corresponding each one of the incidence faces 11 of the incidence face array 110. The light beam "a" is reflected by corresponding each one of the prisms 12, and exits from corresponding each one of the exit faces 13 of the exit face array 130. Therefore, the prism array 120 is disposed after the incidence face array 110 to direct the light beam "a" to the exit face array 130, wherein the prism array 120 is angled 45 degrees with respect to a direction perpendicular to the arrangement direction of the incidence face 11. Further, an apex angle of the prism array 120 is, for example, 90 degrees to be described later.

The exit face array 130 is angled 90 degrees with respect to the direction perpendicular to the arrangement direction of the incidence face 11. Therefore, the light beam "a" emitted from a given point at the incidence face array 110 side enters the corresponding incidence face 11, and is reflected by the corresponding prism 12 facing the corresponding incidence face 11, and then exits from the corresponding exit face 13.

The RPLA 1 is an optical element, which integrates the incidence face array 110, the prism array 120 and the exit face array 130 as one element, and the RPLA 1 is made of, for example, resin by using a molding method.

Figure 2:
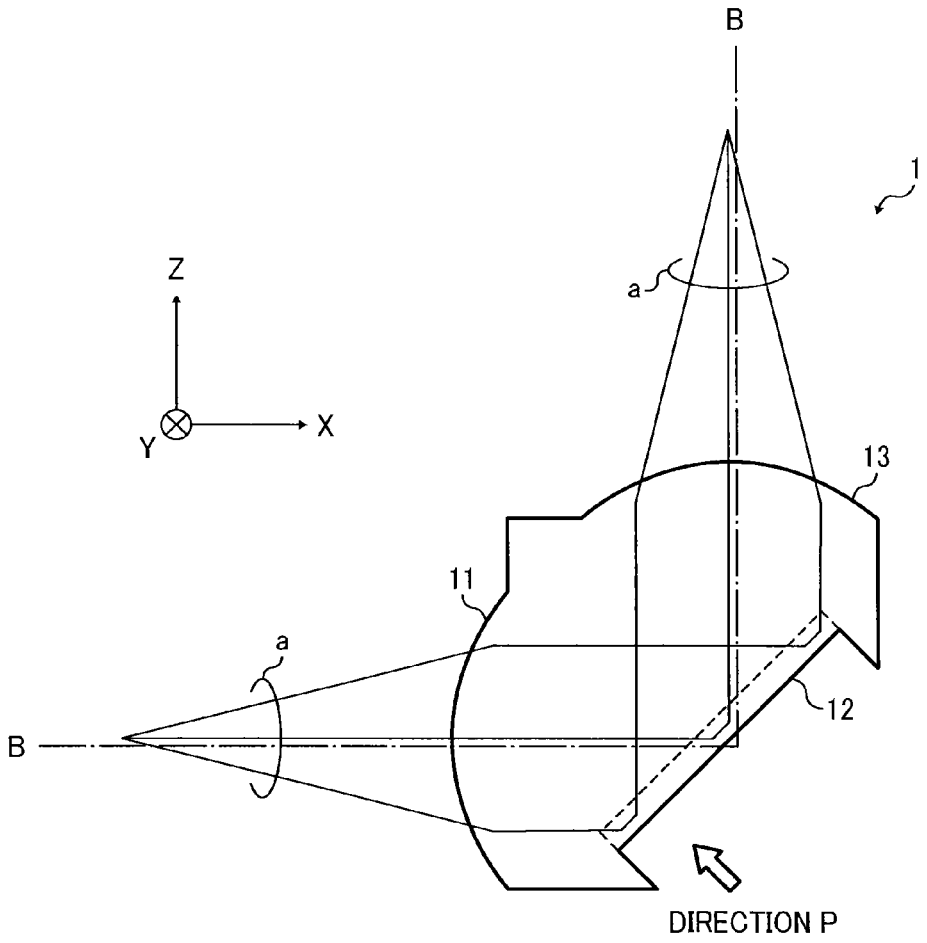
FIG. 2 is a schematic cross-sectional view of the imaging system of FIG. 1 viewed from a short side direction, in which a light path is shown.

A description is given of the RPLA 1 with reference to FIG. 2. FIG. 2 is a schematic cross-sectional view of the RPLA 1 of FIG. 1 viewed from a short side direction, in which a light path is shown. FIG. 2 is a schematic XZ cross-sectional view parallel to the XZ-plane passing a face top of an optical face, and FIG. 2 is a schematic cross-sectional view of the RPLA 1 cut at a line A-A in FIG. 3.

As shown in FIG. 2, the light beam "a" entering from the incidence face 11 of the RPLA 1 is reflected by the prism 12 along the Z direction by reflecting the light path for 90 degrees to the Z direction, and then exits from the exit face 13. The light beam "a" exiting from the exit face 13 is focused on a substantially one point on an imaging face as an image.

Figure 3:
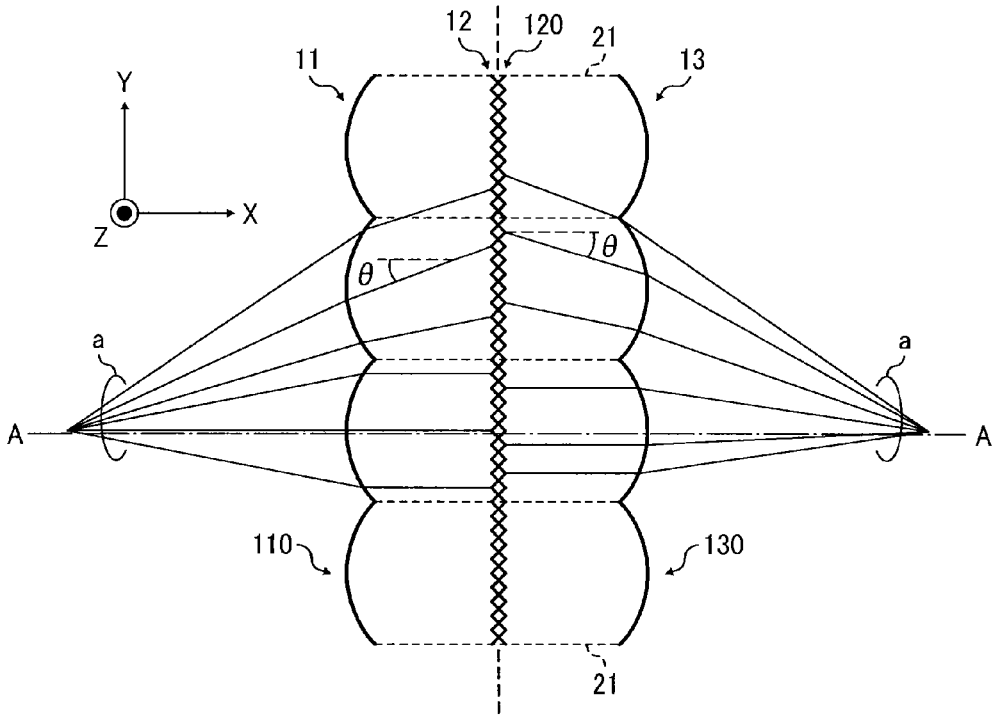
FIG. 3 is a schematic cross-sectional view of the imaging system of FIG. 1 viewed from a long side direction, in which a light path is shown.

FIG. 3 schematically shows a light path for the RPLA 1 viewed from a long side direction. FIG. 3 shows a cross-sectional shape parallel to the XY-plane at a left side and a cross-sectional shape parallel to the YZ-plane at a right side while using the prism 12 as the center.

FIG. 3 is a schematic cross-sectional view of a plane parallel to the Y direction while passing the center of each of the incidence face 11, the prism 12 and the exit face 13. FIG. 3 is a schematic cross-sectional view of the RPLA 1 cut at a line B-B in FIG. 2. FIG. 3 is prepared by folding a cross section area from the exit face 13 to the prism 12 for 90 degrees in the X direction, and the cross section area from the exit face 13 to the prism 12 is set parallel to a cross section area from the incidence face 11 to the prism 12. Further, in FIG. 3, a virtual plane extending from an end of the incidence face 11 and an end of the corresponding exit face 13 in the Y direction is indicated as a virtual plane 21.

Figure 4:
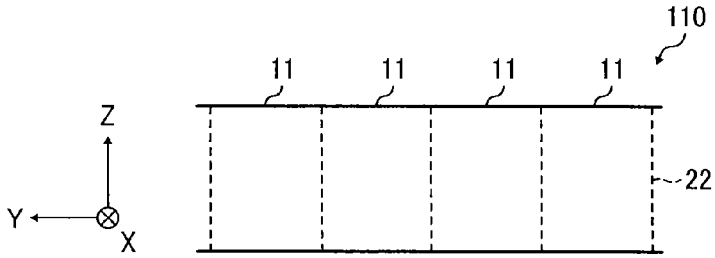
FIG. 4 is a schematic view of an optical face of the imaging system of FIG. 1 viewed from a light source side.

FIG. 4 is a schematic view of an optical face of the incidence face 11 viewed from a light source side or X direction. In FIG. 4, a boundary line of adjacent incidence faces 11 is indicated as a boundary line 22.

Figure 5A:
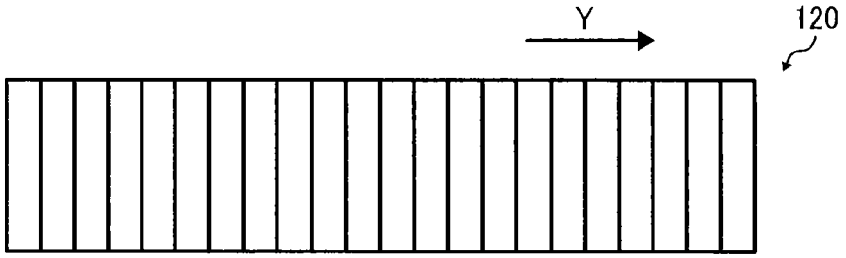
FIG. 5A is a schematic view of a prism array viewed from a direction perpendicular to an arrangement face.
Figure 5B:
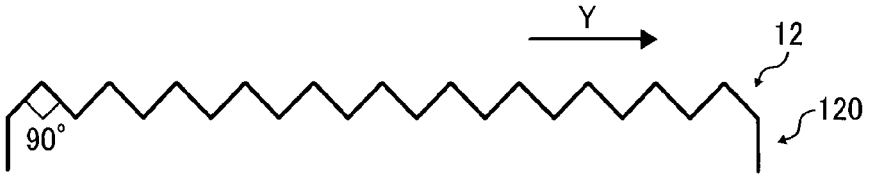
FIG. 5B is a schematic cross-sectional view of a prism array along a long side direction.

FIG. 5A is a schematic view of a prism array viewed from one direction (direction P in FIG. 2) perpendicular to an arrangement face of the prism array 120, and shows ridgelines of mountains and valleys of the prism 12. FIG. 5B is a schematic cross-sectional view of the prism array 120 along a long side direction, and the cross-sectional face is parallel to a plane angled 45 degrees with respect to the XY-plane. As shown in FIG. 5B, an apex angle of each of the prisms 12 composing the prism array 120 is 90 degrees.

As shown in FIGS. 1 and 3, in the RPLA 1, a plurality of the incidence faces 11 is arranged along the first axial direction with a first pitch, and a plurality of the exit faces 13 is arranged along the first axial direction with a third pitch. The first pitch and the third pitch are the same pitch. Further, a plurality of the prisms 12 is arranged along the first axial direction with a second pitch. The second pitch is set shorter than the first pitch and the third pitch. For example, the first pitch of the incidence face 11 and the third pitch of the exit face 13 are set to 0.8 mm, and the second pitch of the prism 12 is set to 0.01 mm.

In the RPLA 1, the light beam "a" entering from the incidence face 11 reflects totally two times at the prism 12 of the prism array 120. Therefore, in the Y direction, the light beam "a" entering from one incidence face 11 exits to one corresponding exit face 13 with an exit angle, which is same as an incidence angle to the prism 12. The incidence angle to the prism 12 and the exit angle from the prism 12 are referred to as an angle θ.

As shown in FIG. 3, the RPLA 1 is a retroreflective optical system. With this configuration, the RPLA 1 can form an upright image along the arrangement direction. Therefore, the light beam "a" coming from one point on an object passes a plurality of the incidence faces 11 and is then focused at a substantially one point. Because the RPLA 1 is the retroreflective optical system in the Y direction, a brighter image can be formed.

Further, as shown in FIG. 2, in the XZ-plane of the RPLA 1, the light beam "a" entering from the incidence face 11 is totally reflected on the prism 12 and exits from the exit face 13 by bending the light path for 90 degrees, which means the RPLA 1 focuses an image at two faces such as the incidence face 11 and the exit face 13 in the XZ-plane. Therefore, the RPLA 1 forms an inverted image in a direction perpendicular to the arrangement direction.

Figure 6A:
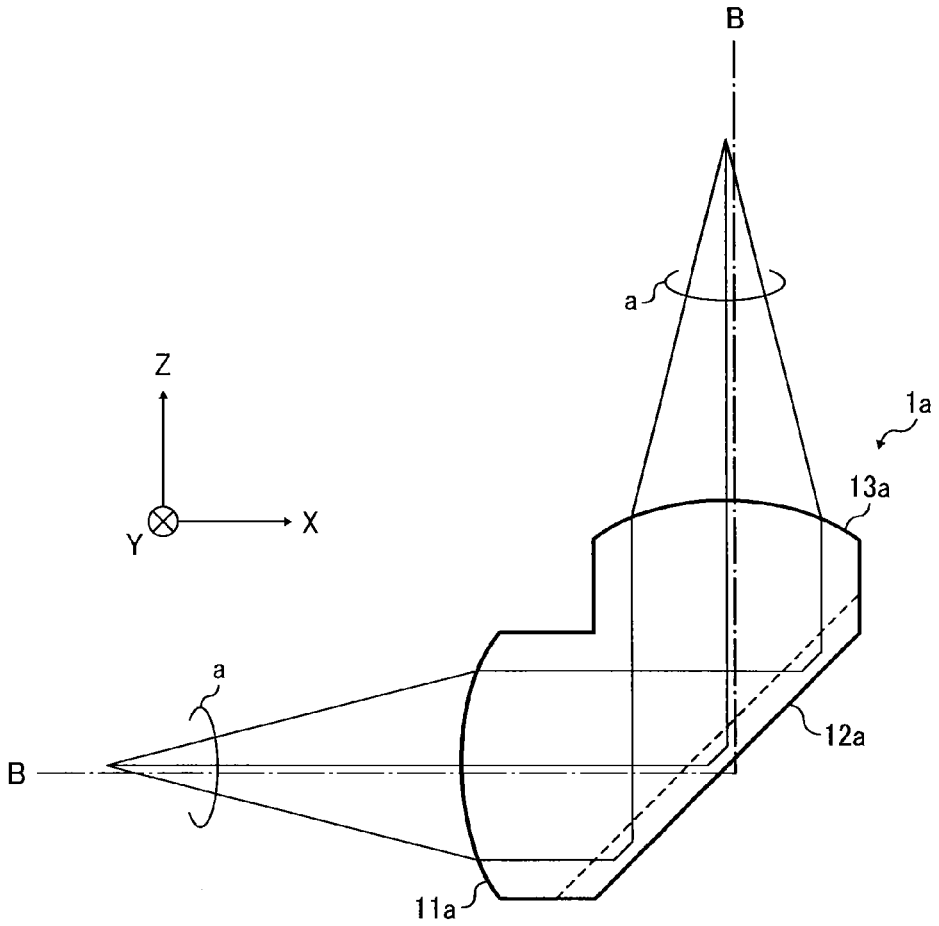
FIG. 6A RELATED ART
FIGS. 6A and 6B are schematic cross-sectional view of conventional imaging system showing a light path.
Figure 6B:
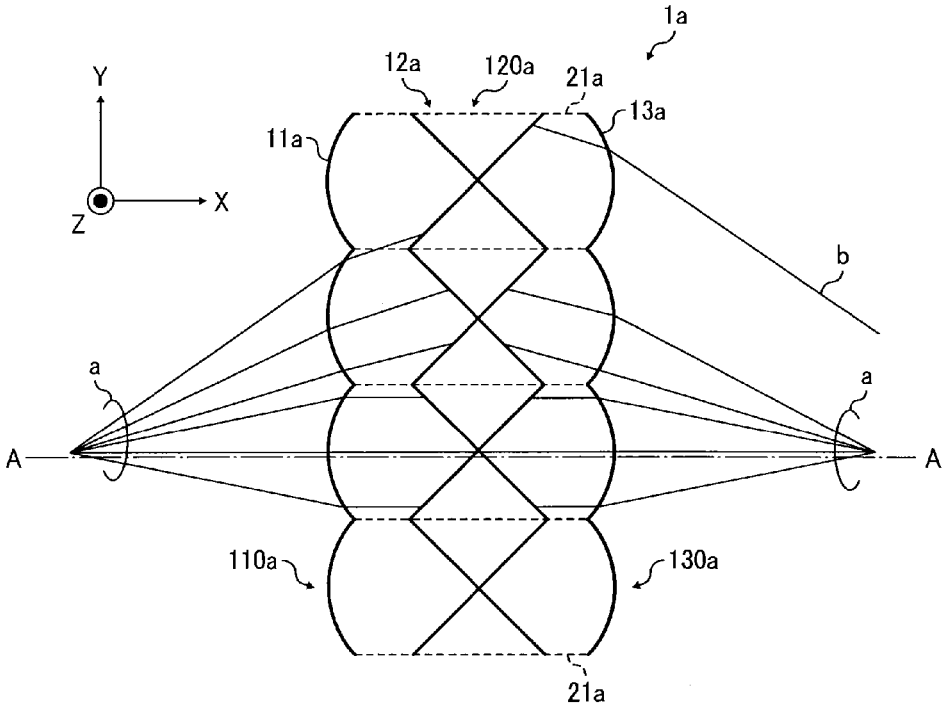
FIG. 6B RELATED ART

A description is given of an effect of the RPLA 1. FIG. 6 is a schematic cross-sectional view of a RPLA 1*a* of conventional imaging system. FIG. 6A is a schematic cross-sectional view of the RPLA 1*a* in the short side direction, in which a light path is shown as similar to FIG. 2. FIG. 6B is a schematic cross-sectional view of the RPLA 1*a* viewed from the long side direction, in which a light path is shown as similar to FIG. 3.

As shown in FIG. 6B, when the pitch of the prism 12*a* is set same as the pitch of the incidence face 11*a* and the pitch of the exit face 13*a*, the light beam "a" passing through the virtual plane 21*a* extending from an end of the incidence face 11*a* and an end of the exit face 13*a* in the arrangement direction may not be focused on a desired position on an imaging face as indicated by light beam "b" in FIG. 6B. The light beam "b" not focused on the imaging face becomes ghost light.

Therefore, if the pitch of the prism 12*a* is set same as the pitch of the incidence face 11*a* and the pitch of the exit face 13*a*, a position of the light beam "a" on a prism lens array 120*a* in the Y direction may deviate, in which the light beam "b" passing one incidence face 11*a* and one exit face 13*a* that are not a designed pair of the incidence face and the exit face is generated, and the deviated light beam "b" becomes ghost light.

Therefore, as above described for the RPLA 1 of the example embodiment, when the pitch of the prism 12 is set smaller than the pitch of the incidence face 11, a positional deviation of the light beam "a" that has passed the virtual plane 21, extending from the end of the incidence face 11 and the end of the corresponding exit face 13 in the Y direction, on the prism array 120 becomes small (see FIG. 3).

In the RPLA 1, at the same position in the first axial direction (Y direction), one optical face (incident optical face) in the incidence face 11 and one optical face (exit optical face) in the exit face 13 are paired. The light beam "a" emitted from the point light source enters the incident optical face paired with the exit optical face. Some of the light beam "a" entering the incident optical face passes the virtual plane 21 extending from the end of the incident optical face (incidence face 11) and the end of the corresponding exit optical face (exit face 13) in the Y direction, and is then reflected by the prism 12, and then passes the virtual plane 21 again, and goes to the exit optical face.

In the above described RPLA 1, the light beam "a" entering from the incidence face 11 and reflected by the prism 12 exits from the exit face 13, which is a pair of the incidence face 11, and focused. Therefore, occurrence of ghost light can be prevented. Further, because the light beam "a" can be focused at a desired position, a brighter image can be formed.

Second Example Embodiment of Imaging System

A description is given of an imaging system according to a second example embodiment. Some of the same configuration of above described first example embodiment is applied to the second example embodiment, and the same reference numbers or characters are assigned for the same parts without detail description, and a difference of the second example embodiment is described.

In addition to the above described reasons causing the ghost light to the imaging system, other reasons may cause the ghost light. For example, a relative position error of the incidence face 11, the prism 12, and the exit face 13, and a relative position error of a light source and the RPLA 1 may cause the ghost light. If such error exists, the light beam "a" may reach an imaging face without passing the incidence face 11, the prism 12 and the exit face 13 in this order. If the light beam "a" not passing through a normal light path reaches the imaging face, the light beam "a" becomes the ghost light.

To prevent the ghost light caused by the above described relative position error, an aperture can be disposed between the light source and the incidence face 11 of the RPLA 1 to block the light beam "a" near the end portion of the incidence face 11 in the Z direction.

However, when the aperture is disposed before the incidence face 11, the number of parts increases. Further, because the aperture and the incidence face 11 need a correct positioning, manufacturing cost increases. Further, a shape of the aperture needs to a long and thin slit in the Y direction. The aperture having this long and thin slit shape is difficult to process, and the strength of the aperture becomes weak. Therefore, the anti-mechanical vibration performance of the aperture becomes weak.

In view of such issues of using the aperture, the RPLA 1 of the second example embodiment uses the prism 12 having an aperture function. Specifically, the prism 12 having the aperture function and the incidence face 11 and the exit face 13 are integrated as one integrated structure, with which precision of a relative position of the incidence face 11 and the prism 12 having aperture function can be enhanced. Further, by using the integrated structure, the strength can be enhanced, and the anti-mechanical vibration performance can be enhanced.

Figure 7:
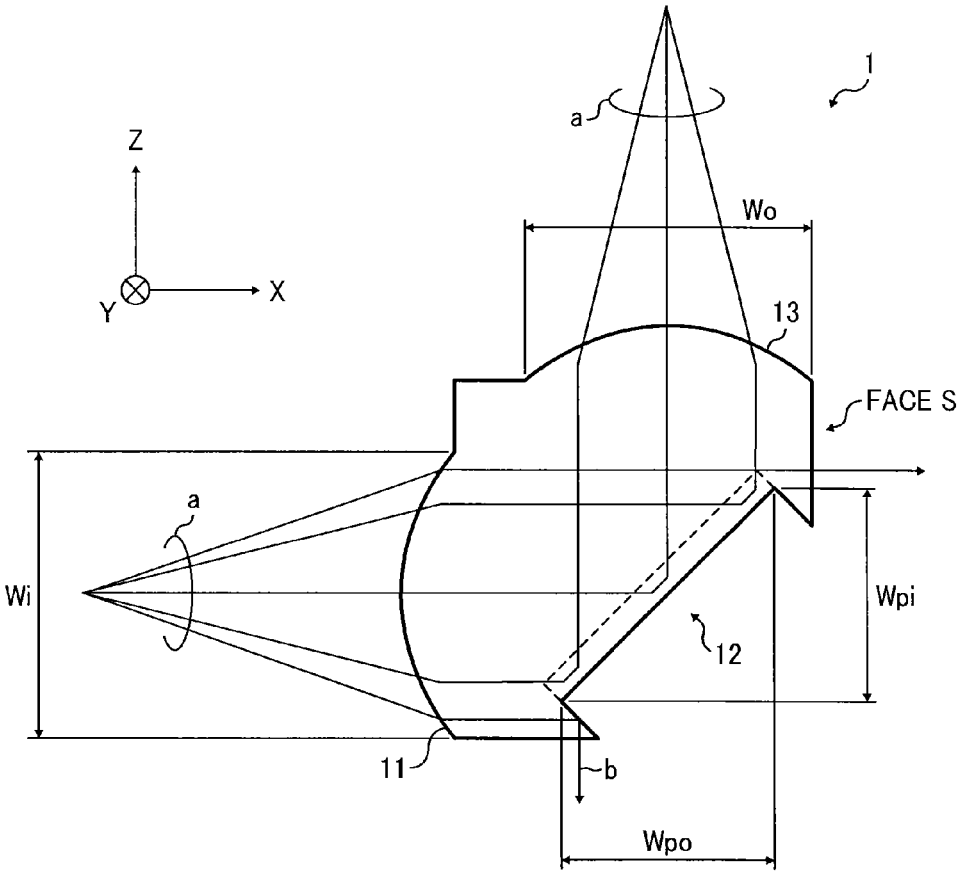
FIG. 7 is a schematic cross-sectional view of an imaging system according to another example embodiment viewed from a short side direction, in which a light path is shown.

With reference to FIG. 7, a description is given of the RPLA 1 employing the prism 12 having the aperture function. FIG. 7 is a schematic cross-sectional view of the RPLA 1 showing a light path of as similar to FIG. 2. As shown in FIG. 7, in the XZ plane passing a face top of one optical face of the incidence face 11, a width of the incidence face 11 in the Z-axial direction is set as "Wi," and a width of the prism 12 in the Z-axial direction is set as "Wpi" in the same XZ plane.

If the width relationship is Wi≤Wpi, some of the light beam "a" coming from the light source may not pass though a route of the incidence face 11→the prism 12→the exit face 13 due to the relative position error of the incidence face 11, the prism 12 and the exit face 13, and the relative position error of the light source and the RPLA 1.

For example, the light beam "b" that has passed the incidence face 11 and the prism 12 may pass a face other than the exit face 13, and then reaches the imaging face, in which the light beam "b" becomes the ghost light.

In view of such issue, in the RPLA 1 of the second example embodiment, a configuration having a width relationship of Wi>Wpi is used. Specifically, in the XZ plane passing a face top of an optical face of the incidence face 11, a width Wpi of the prism 12 in the Z direction is set smaller than a width Wi of optical face of the incidence face 11 in the Z direction. When the RPLA 1 satisfying this condition is used, only a part of the light passing through the incidence face 11 can enter the prism 12.

In other words, some of the light beam "a" emitted from the light source and passing through the incidence face 11 is not entered to the prism 12. The light beam "b" not entering the prism 12 does not go to the exit face 13 side (imaging face side), with which the light beam "b" does not become the ghost light. As above described, by adjusting a length of the incidence face 11 and a length of the prism 12 in the Z direction, the aperture function can be set to the prism 12. With this configuration, even if the relative position error occurs to the incidence face 11, the prism 12 and the exit face 13, the light beam "b" not passing a normal route (incidence face 11→prism 12→exit face 13) does not reach the imaging face, with which occurrence of ghost light can be suppressed.

If the pitch (lens pitch) of the incidence face 11 and the exit face 13 is same as the pitch of the prism 12, as above described, the effect of the ghost light caused by a deviation of a position of the light on the prism lens array 120 in the Y direction becomes great. Therefore, the ghost light caused by other reason is not so prominent.

However, when the RPLA 1 of the second example embodiment is used, a brighter image can be focused, and the ghost light caused by a deviation of a position of the light on the prism lens array 120 in the Y direction can be reduced greatly. Therefore, the effect of the ghost light caused by the light beam "b" that reaches the imaging face without passing the normal route (incidence face 11→prism 12→exit face 13) becomes prominent.

As to the RPLA 1 of the second example embodiment, the aperture function can be included to the prism 12. Therefore, occurrence of prominent ghost light can be prevented, and brighter image can be formed effectively.

If the light source uses a light emitting diode (LED) and an organic electroluminescence (OEL), light emitted from LED and OEL becomes a light having broader light area. Therefore, a ratio of light not entering the incidence face of the imaging system becomes greater. If such light source (e.g., LED, OEL) is used, the ghost light may occur more likely. To suppress the effect of broader light coming from the light source, an aperture can be disposed at the incidence face side. However, it is very difficult to manufacture an aperture array matched to each incidence face of the imaging system with high precision. Therefore, if the RPLA 1 having the aperture function is used for the imaging system when the light source employs the LED and OEL, occurrence of ghost light can be suppressed effectively. The RPLA 1 having the aperture function is suitable as the imaging system when the light source uses a light having broader light area.

Third Example Embodiment of Imaging System

When the prism 12 having the aperture function is applied for the RPLA 1, the aperture function can be set not only at the incidence face 11 side, but also at the exit face 13 side.

As shown in FIG. 7, in the XZ plane passing a face top of an optical face of the exit face 13, a width of the optical face in the exit face 13, which is a width of the exit face 13 in the X-axial direction is set as "Wo", and a width of the prism 12 in the X-axial direction is set as "Wpo." By setting the width Wpo of the prism 12 in the X direction smaller than the width Wo of optical face in the exit face 13, which means, by setting a configuration satisfying Wo>Wpo, the aperture function can be set to the exit face 13 side of the prism 12.

With this configuration, even if the relative position error occurs to the incidence face 11, the prism 12, and the exit face 13, occurrence of ghost light can be further suppressed effectively.

Fourth Example Embodiment of Imaging System

A description is given of an imaging system according to fourth example embodiment. Based on setting the size of the prism 12 in line with the above described RPLA 1, a face (e.g., face S in FIG. 7) connecting the prism 12 and the exit face 13 is set with a given angle. The light passing the incidence face 11 but not passing the prism 12 goes to the face S. With this configuration, the light that causes the ghost light exits outside the RPLA 1 from the face S.

In this configuration, for example, the face S is set parallel to the YZ-plane. Because the light not entering the prism 12 can exit outside the RPLA 1 from a face (e.g., face S) connecting the prism 12 and the exit face 13, unnecessary light can be directed to a direction different from the imaging face, with which occurrence of ghost light can be suppressed.

Fifth Example Embodiment of Imaging System

A description is given of an imaging system according to fifth example embodiment. In relation to the RPLA 1 of the above described example embodiment, a configuration to exit the light from a face of the RPLA 1, connecting the incidence face 11 and the prism 12, can be configured with different settings.

Figure 8:
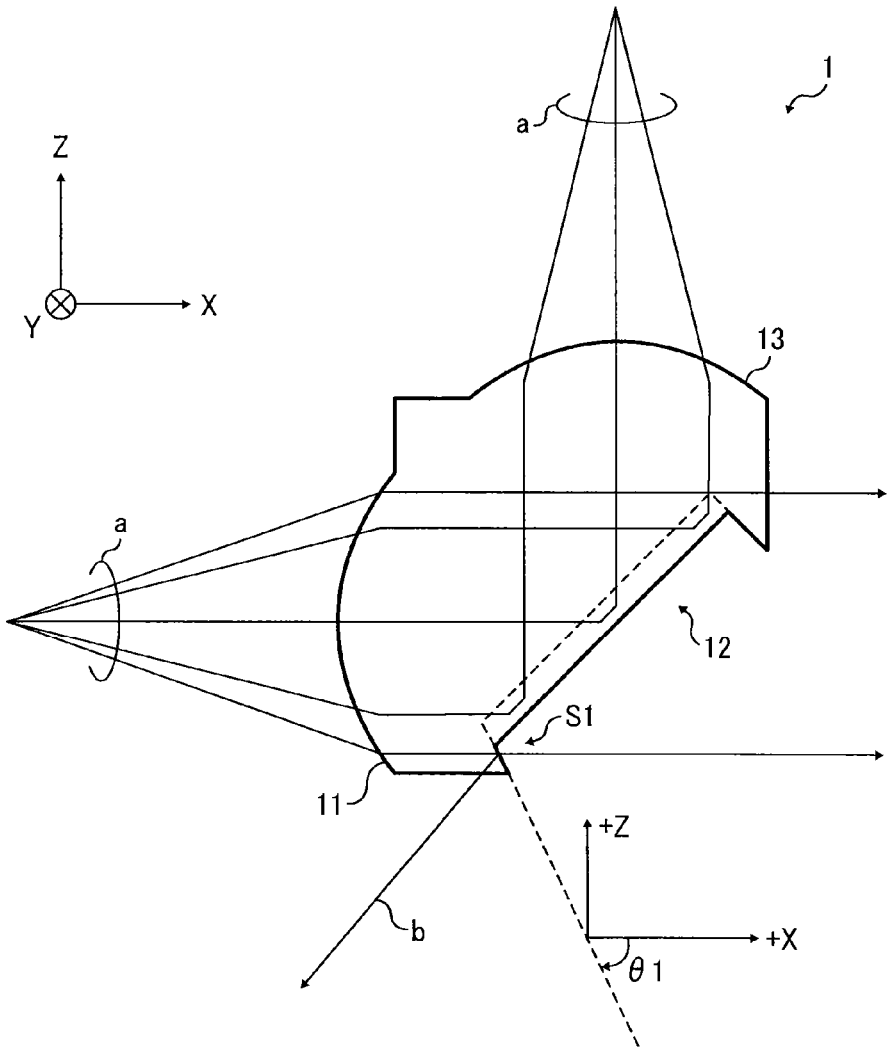
FIG. 8 is a schematic cross-sectional view of an imaging system according to still another example embodiment viewed from a short side direction, in which a light path is shown.

As shown in FIG. 8, in the XZ plane passing a face top of an optical face of the incidence face 11, a direction from the incidence face 11 toward the prism 12 is set as a positive direction, and a direction from the prism 12 toward the exit face 13 is set as a positive direction. Further, an angle from the incidence face 11 toward the exit face 13 is set as a positive angle.

As shown in FIG. 8, in the RPLA 1 of the fifth example embodiment, an angle θ1 defined by a side face S1 connected to the incidence face 11, which is one of side faces connected to the prism 12, and a positive X-axial direction is set within a given value.

If the angle θ1 is set "0 deg≤θ1<90 deg," the light entering the incidence face 11 but not entering the prism 12 reflects at the side face S1 and is directed to the imaging face direction (direction to the exit face 13 or +Z direction), and this light may cause the ghost light.

In the RPLA 1 of the fifth example embodiment, the angle θ1 defined by the side face S1 and +X axis is set to satisfy a range of "−90 deg≤θ1≤0 deg" (condition 1). With this configuration, the light entering the incidence face 11 but not entering the prism 12 passes the side face S1 or is reflected at the side face S1 to a direction different from the exit face 13. Because the light that may cause the ghost light can exit outside the RPLA 1, occurrence of ghost light can be suppressed.

Sixth Example Embodiment of Imaging System

A description is given of an imaging system according to a sixth example embodiment. In relation to the RPLA 1 of the above described example embodiment, a configuration to exit the light outside the RPLA 1 from a face connecting the prism 12 and the exit face 13 can be configured with different settings.

Figure 9:
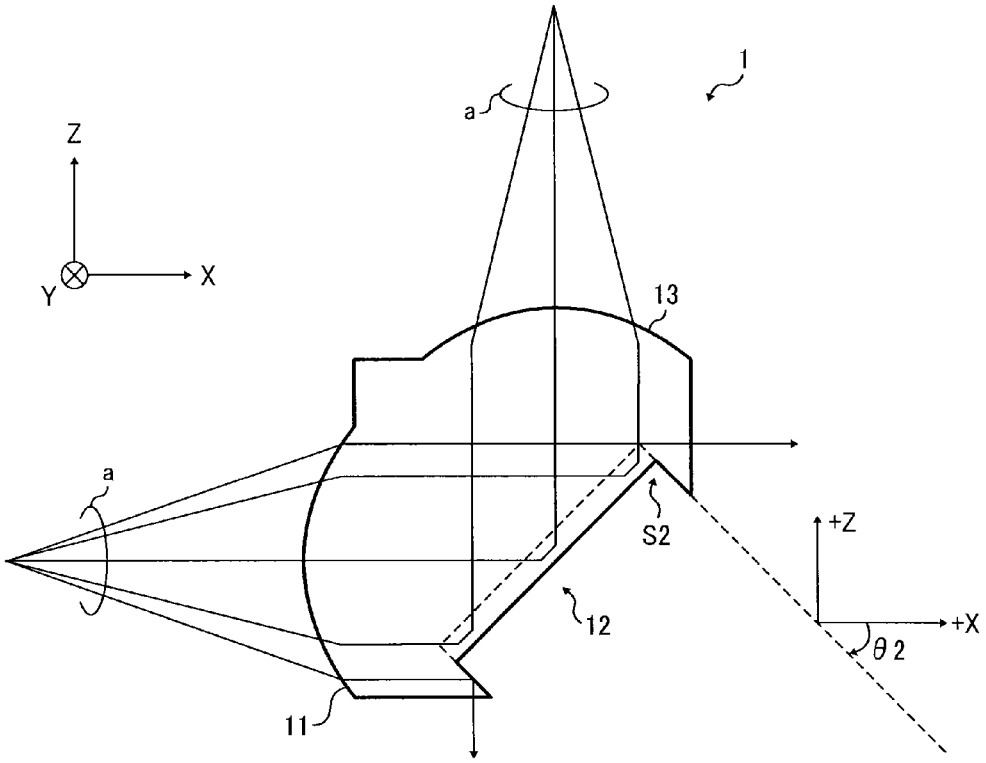
FIG. 9 is a schematic cross-sectional view of an imaging system according to still another example embodiment viewed from a short side direction, in which a light path is shown.

As shown in FIG. 9, in the XZ plane passing a face top of an optical face of the incidence face 11, a direction from the incidence face 11 toward the prism 12 is set as a positive direction, and a direction from the prism 12 toward the exit face 13 is set as a positive direction. Further, an angle from the incidence face 11 toward the exit face 13 is set as a positive angle.

As shown in FIG. 9, in the RPLA 1 of the sixth example embodiment, among side faces connected to the prism 12, an angle Γ2 defined by a side face S2 connected to the exit face 13, which is one of side faces connected to the prism 12, and a positive X-axial direction is set within a given value.

If the angle θ2 is set "0 deg≤θ2," the light entering the incidence face 11 but not entering the prism 12 reflects at the side face S2 and is directed to the imaging face direction (direction to the exit face 13 or +Z direction), and this light may cause the ghost light.

In the RPLA 1 of the six example embodiment, the angle θ2 defined by the side face S2 and +X axis is set to satisfy a range of "−90 deg≤θ2≤0 deg" (condition 2). With this configuration, the light entering the incidence face 11 but not entering the prism 12 does not enter the side face S2, with which occurrence of ghost light can be suppressed.

Seventh Example Embodiment of Imaging System

A description is given of an imaging system according to a seventh example embodiment. In relation to the RPLA 1 of the above described example embodiment, a configuration to exit the light outside the RPLA 1 from a face connecting the prism 12 and the exit face 13 can be configured with different settings.

Figure 10:
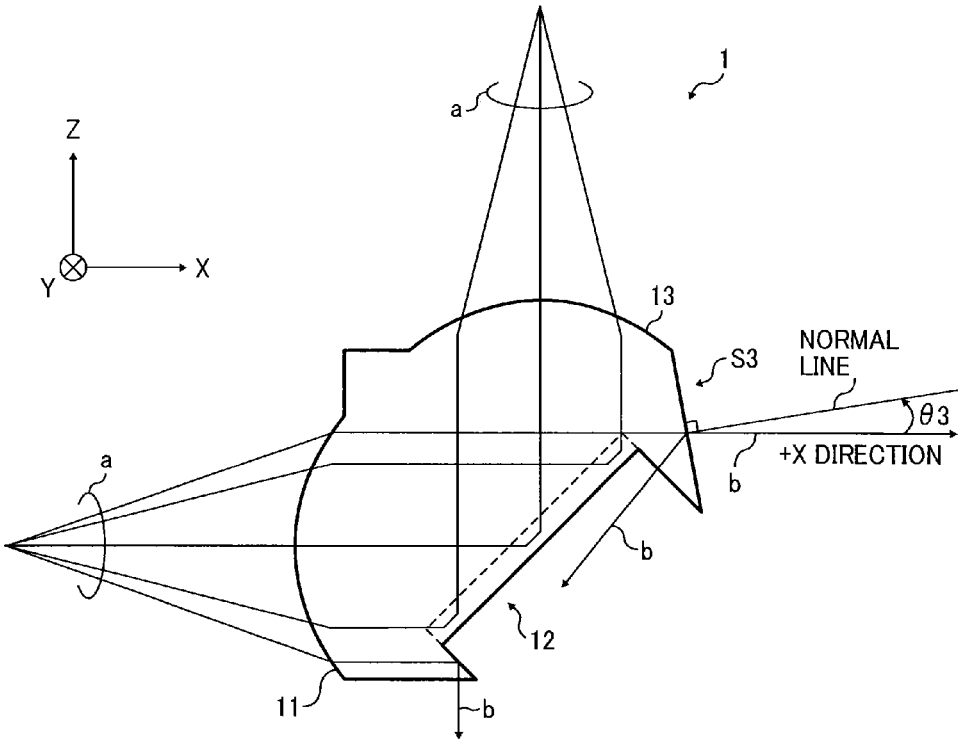
FIG. 10 is a schematic cross-sectional view of an imaging system according to still another example embodiment viewed from a short side direction, in which a light path is shown.

A shown in FIG. 10, in the XZ plane passing a face top of an optical face of the incidence face 11, a direction from the incidence face 11 toward the prism 12 is set as a positive direction, and a direction from the prism 12 toward the exit face 13 is set as a positive direction. Further, an angle from the incidence face 11 toward the exit face 13 is set as a positive angle.

As shown in FIG. 10, in the RPLA 1 of the seventh example embodiment, among side faces connected to the prism 12, a side face S3 connecting the prism 12 and the exit face 13 is set as one side face connected to the prism 12. A normal line of the side face S3 and a line parallel to the positive X direction axis intersect at one point. An angle θ3 defined by the normal line of the side face S3 and the line parallel to the positive X direction axis is set within a given value.

If the angle θ3 is set "−90 deg≤θ3<40 deg," the light entering the incidence face 11 but not entering the prism 12 totally reflects at the side face S3 and is directed to the imaging face direction (direction to the exit face 13 or +Z direction). Because the total reflection means 100% reflection theoretically, a light having greater intensity is directed to the imaging face direction. This light may cause the ghost light having greater intensity.

In the RPLA 1 of the seventh example embodiment, the angle θ3 defined by the side face S3 and +X axis is set to satisfy a range of "−40 deg≤θ3<90 deg" (condition 3). With this configuration, the light entering the incidence face 11 but not entering the prism 12 passes the side face S3 or is reflected at the side face S3 to a direction different from the exit face 13. Because the light that may cause the ghost light can exit outside the RPLA 1, occurrence of ghost light can be suppressed.

Further, if the angle θ3 is set "−40 deg≤θ3<0 deg," some light may reflect at the side face S3, although a small light quantity, and is directed to the imaging face direction as a reflection light, and this reflection light may cause the ghost light. Therefore, the angle θ3 is preferably set "0 deg≤θ3<90 deg" (condition 4). With this configuration, the reflection light reflected at the side face S3 can be directed to a direction different from the imaging face direction, with which occurrence of ghost light can be suppressed.

(Writing Head)

Figure 11:
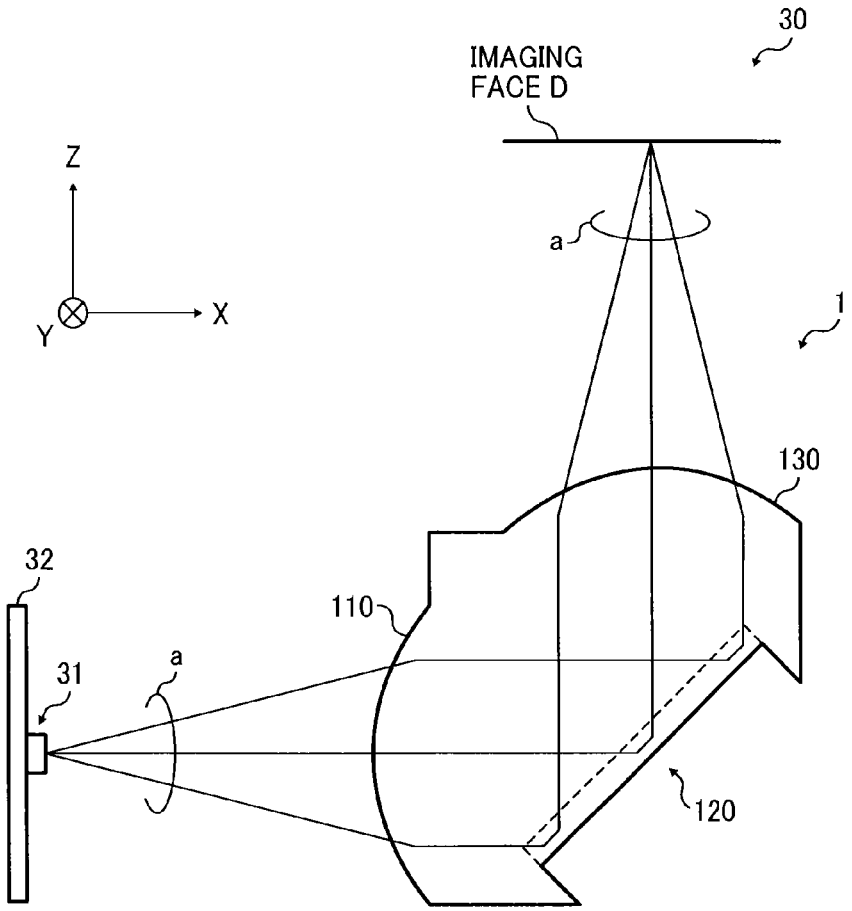
FIG. 11 is a schematic cross-sectional view of a writing head according to an example embodiment viewed from a short side direction, in which a light path is shown.

A description is given of a writing head according to an example embodiment. FIG. 11 is a cross-sectional view of a writing head 30 according to an example embodiment. As shown in FIG. 11, the writing head 30 includes, for example, the RPLA 1, a light source 31 and a board 32. The RPLA 1 is an example of the above described imaging system. The light source 31 includes a plurality of light sources arranged in at least one line pattern in an arrangement direction (Y direction) of the incidence face array 110 of the RPLA 1. The board 32 retains the light source 31 at a given position.

As to the writing head 30, the light beam "a" emitted from the light source 31 enters the incidence face array 110, and is then reflected by the prism array 120, and is focused as an image on an imaging face D via the exit face array 130.

Because the writing head 30 includes above described RPLA 1 as the imaging system, the ghost light does not reach the imaging face D, and a brighter image can be focused.

(Image Forming Apparatus)

Figure 12:
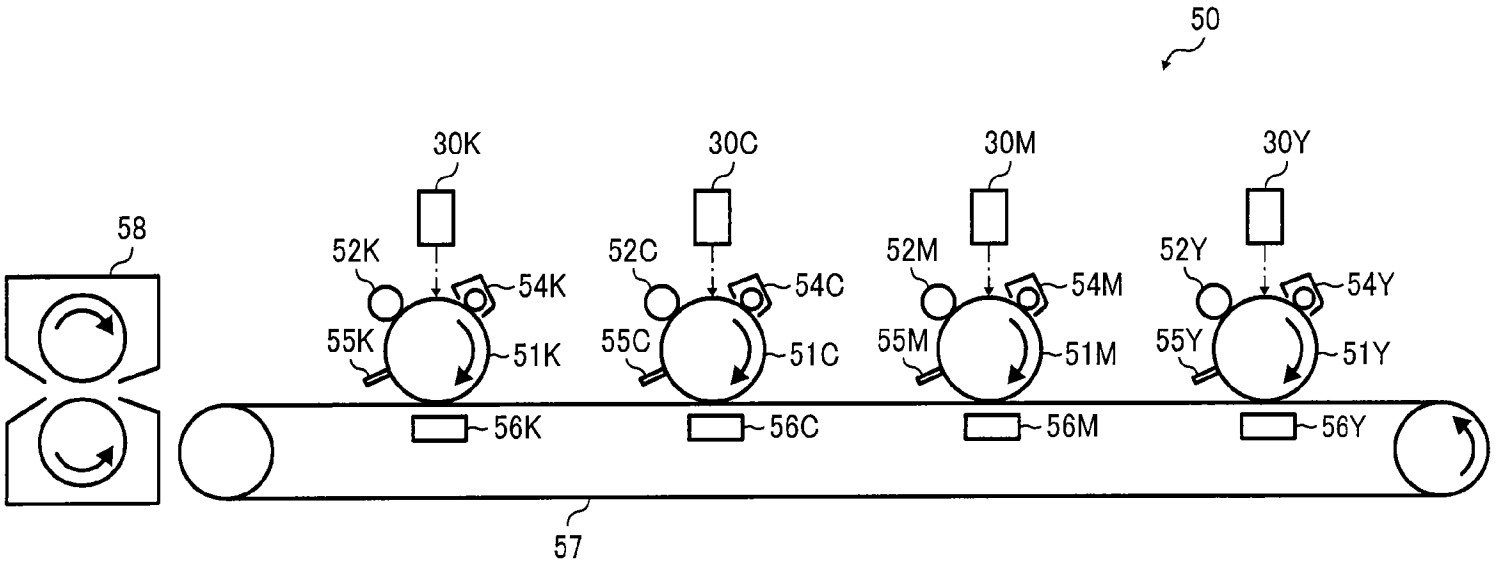
FIG. 12 is a schematic configuration of an image forming apparatus according to an example embodiment.

A description is given of an image forming apparatus according to an example embodiment. FIG. 12 is a schematic configuration of an image forming apparatus 50 according to an example embodiment, which can form multi-color images. As shown in FIG. 12, the image forming apparatus 50 includes, for example, a photoconductor 51 (51Y, 51M, 51C, 51K) used as an image bearing member, a charger 52 (52Y, 52M, 52C, 52K), the writing head 30 (30Y, 30M, 30C, 30K) used as an optical writing unit, a development unit 54 (54Y, 54M, 54C, 54K), a cleaning unit 55 (55Y, 55M, 55C, 55K), a transfer charger 56 (56Y, 56M, 56C, 56K), a transfer belt 57, and a fusing unit 58. Y, M, C and K represent color of image such as yellow, magenta, cyan and black respectively.

A surface of the photoconductor 51 is used as the imaging face, to which an image is focused by the writing head 30 according to the above described example embodiment.

In the image forming apparatus 50, the photoconductors 51Y, 51M, 51C and 51K rotates in a direction shown by arrows in FIG. 12. The chargers 52Y, 52M, 52C, 52K, the development units 54Y, 54M, 54C, 54K, the transfer chargers 56Y, 56M, 56C, 56K, and the cleaning units 55Y, 55M, 55C, 55K are disposed along the respective photoconductors 51Y, 51M, 51C and 51K in this rotation direction.

Each of the chargers 52Y, 52M, 52C, 52K is a charger to charge the surface of the photoconductor 51 uniformly. Upon charging the photoconductors 51Y, 51M, 51C, 51K using the chargers 52Y, 52M, 52C, 52K, the photoconductors 51Y, 51M, 51C, 51K are exposed by an exposure device such as the writing heads 30Y, 30M, 30C, 30K according to an example embodiment to form an electrostatic latent image.

Each of the development units 54Y, 54M, 54C, 54K develops the electrostatic latent image as toner images on the photoconductors 51Y, 51M, 51C, 51K. Further, each of the transfer chargers 56Y, 56M, 56C, 56K is used as a transfer unit to transfer each of toner images onto the transfer belt 57, with which each of toner images is superimposed on the transfer belt 57. Then, the superimposed toner images are transferred on a recording medium such as a recording sheet, and the fusing unit 58 fuses an image on the recording sheet.

As above described, the writing head 30 can devise enhanced light use efficiency and can suppresses occurrence of ghost light. Therefore, the image forming apparatus 50 can output an image without abnormal image while reducing power consumption.

In the above described imaging system, light use efficiency can be enhanced while suppressing the occurrence of ghost light.

Numerous additional modifications and variations are possible in light of the above teachings. It is therefore to be understood that, within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An imaging system, comprising:

a plurality of incidence faces composed of a plurality of optical faces through which light enters and having an image focusing function;

a plurality of prisms; and a plurality of exit faces, wherein the plurality of incidence faces is arranged with a first pitch along a first axial direction, the plurality of prisms is arranged with a second pitch along the first axial direction, the plurality of the exit faces is arranged with a third pitch along the first axial direction, wherein the first axial direction is set as a Y direction, wherein a normal line direction of a face top of an optical face of the incidence face in a plane perpendicular to the first axial direction is set as a X direction, wherein a direction perpendicular to the Y direction and the X direction is set as a Z direction, and wherein in a XZ cross-section plane, a width of the prism in the Z direction is smaller than a width of the optical face of the incidence face in the Z direction.

2. The imaging system of claim 1, wherein the second pitch is shorter than the first pitch and the third pitch.

3. The imaging system of claim 1, wherein in the XZ cross-section plane, a width of the prism in the X direction is smaller than a width of optical face of the exit face in the X direction.

4. The imaging system of claim 1, wherein a part of light emitted from a point light source and passing the incidence face does not enter the prism.

5. The imaging system of claim 4, wherein the light not entering the prism exits outside the imaging system from a part of a face connecting the prism and the exit face.

6. The imaging system of claim 5, wherein in the XZ cross-section plane, the X direction from the incidence face toward the prism is set as a positive direction, the Z direction from the prism toward the exit face is set as a positive direction, and an angle from the X direction to the Z direction is set as a positive angle, wherein among side faces connected to the prism, an angle $\theta 1$ defined by a side face connected to the incidence face and the positive X direction satisfies a first condition: $-90 \text{ deg} \leq \theta 1 < 0 \text{ deg}$.

7. The imaging system of claim 5, wherein in the XZ cross-section plane, the X direction from the incidence face toward the prism is set as a positive direction, the Z direction from the prism toward the exit face is set as a a positive direction, and an angle from the X direction to the Z direction is set as a positive angle, wherein among side faces connected to the prism, an angle $\theta 2$ defined by a side face connected to the exit face and the positive X direction satisfies a second condition: $-90 \text{ deg} \leq \theta 2 < 0 \text{ deg}$.

8. The imaging system of claim 5, wherein in the XZ cross-section plane, the X direction from the incidence face toward the prism is set as a positive direction, the Z direction from the prism toward the exit face is set as a positive direction, and an angle from the X direction to the Z direction is set as a positive angle, wherein a light path of light passing through a portion of the incidence face but not entering the prism and entering a side face connecting the prism and the exit face, wherein a normal line of the side face, connecting the prism and the exit face, and a line parallel to the positive X direction axis intersect at one point, wherein an angle $\theta 3$ defined by the normal line of the side face, connecting the prism and the exit face, and the line parallel to the positive X direction axis satisfies a third condition: $-40 \text{ deg} \leq \theta 3 < 90 \text{ deg}$.

9. The imaging system of claim 8, wherein the angle $\theta 3$ further satisfies a fourth condition: $0 \text{ deg} < \theta 3 < 90 \text{ deg}$.

10. The imaging system of claim 1, wherein light emitted from a light source enters a plurality of optical faces of the incidence face, exits from the plurality of optical faces of the exit face, and is then focused at a substantially one point.

11. The imaging system of claim 1, wherein one optical face of the incidence face and one optical face of the exit face existing at the same position with respect to the first axial direction are paired, wherein a virtual plane connects an end of the paired optical face of the incidence face in the first axial direction and an end of the paired optical face of the exit face in the first axial direction, wherein among light emitted from a point light source and entering the paired optical face of the incidence face, light passing through the virtual plane is reflected by the prism, and then passing through the virtual plane again, and then going to the paired optical face of the exit face.

12. A writing head, comprising:

a light source array having a plurality of light sources arranged in at least one line pattern;

a board to retain the light source array; and the imaging system of claim 1 to which light from the light source array enters.

13. An image forming apparatus, comprising:

the writing head of claim 12;

an image bearing member;

a development unit to develop an electrostatic latent image formed on the image bearing member as a toner image by the writing head using each color of toner; and a transfer unit to transfer the toner image developed on the image bearing member to a recording medium.

* * * * *